United States Patent [19]

Tooka

[11] 3,973,906

[45] Aug. 10, 1976

[54] CHEESE HANDLING METHOD

[75] Inventor: Takuzo Tooka, Toyoake, Japan

[73] Assignee: Kabushiki Kaisha Toyoda Jidoshokki Seisakusho, Kariya, Japan

[22] Filed: Nov. 25, 1974

[21] Appl. No.: 527,146

[30] Foreign Application Priority Data

Dec. 6, 1973 Japan ..... 48-136552

[52] U.S. Cl. ..... 8/149.3; 28/21; 28/58 B; 57/34 HS; 68/3 R; 214/152; 242/18 R

[51] Int. Cl.[2] ..... B08B 3/00

[58] Field of Search ..... 214/38 R, 41, 8, 152; 28/21, 58 B; 57/34 R, 53; 68/3 R, 5 R, 5 C; 8/149.3, 155.2; 34/12, 105

[56] References Cited

UNITED STATES PATENTS 1,540,926 6/1925 Brandwood et al. ..... 28/58 B X

*Primary Examiner*—Robert G. Sheridan

*Attorney, Agent, or Firm*—Wenderoth, Lind & Ponack

[57] ABSTRACT

Cheeses produced by spinning machinery are canistered in a plurality of cylindrical containers in a manner allowing bobbins of the cheeses to be stacked in end-to-end relationship. A cheese transportation vehicle transfers the containers to a processing position where the cheeses therein are processed and handled by at least one container unit.

4 Claims, 3 Drawing Figures

CHEESE HANDLING METHOD

BACKGROUND OF THE INVENTION

This invention relates to a method and an arrangement for handling cheeses produced by spinning machinery, such as a spinning frame, a false twisting machine, a double twister or a winder.

In an open end spinning frame, for example, a series of spinning units are arranged between head stocks wherein drive motors, gear boxes and control mechanisms are located. A sliver from each can is spun by a spinning device of the spinning unit into a yarn which is, in turn, taken up by a spun yarn take-up roller and wound through a grooved winding roller on a bobbin to be formed into a yarn package or cheese. Each cheese is doffed and transported to a separate apparatus to be subject to the next processing step of the spinning.

Heretofore, in order to transport the cheeses from the spinning machinery to the separate apparatus, one of the following three systems has been employed:

1. Doffing the cheeses, placing them into a cheese storing car and moving the car to the separate apparatus.

2. Doffing the cheeses, placing them onto a conveyer provided along the spinning machinery, driving the conveyer to move the cheeses to the end of the spinning machinery at which they are transferred into a suitable container, and moving the container to the separate apparatus.

3. Doffing the cheeses, and directly transporting them to the separate apparatus by hanging them on movable hangers.

Among the steps composing each of these transporting systems, the doffing has been effected automatically. However, it has been practice that, in carrying out the process next to the spinning process, the cheeses once stored in the container or the cheese storing car are manually taken out therefrom to be processed and after being processed the cheeses are manually repositioned in the container or the cheese storing car to be transported to a further processing station. This has been disadvantageous in that, for example, additional time and labor are required.

SUMMARY OF THE INVENTION

It is accordingly an object of the invention to provide a system for transporting cheeses produced by spinning machinery, such as a spinning frame, a double twister or a winder, which eliminates the above disadvantages and in which the cheeses are divided into a plurality of groups and each group of cheeses are placed in associated one of plural cylindrical containers arranged in circle on a vehicle so that they can be subject to a subsequent process or processes by at least one container unit.

According to the invention, there is no need for taking the cheeses out of and replacing them in the associated container every time they are transported from one another processing position. This has various advantages such as that the necessary processings can be completed in an automatic manner, reducing the labor required by the operator; and the cheeses can be prevented from being damaged, thus providing spun yarns of good quality. Furthermore, according to the invention, some or all of the cheeses produced during one doffing cycle of the same spinning machinery can be processed as an undivided whole. Where it is discovered during the subsequent processing that there are defects in the yarn, the spinning machinery which has produced the defective yarns can easily be found by numbering both the spinning machines and the cheese transportation vehicles. This allows complete control of the yarn quality.

BRIEF DESCRIPTION OF THE DRAWING

The invention will become more readily apparent from the following detailed description taken in conjunction with the accompanying drawing in which.

DESCRIPTION OF THE EMBODIMENT

Figure 1:
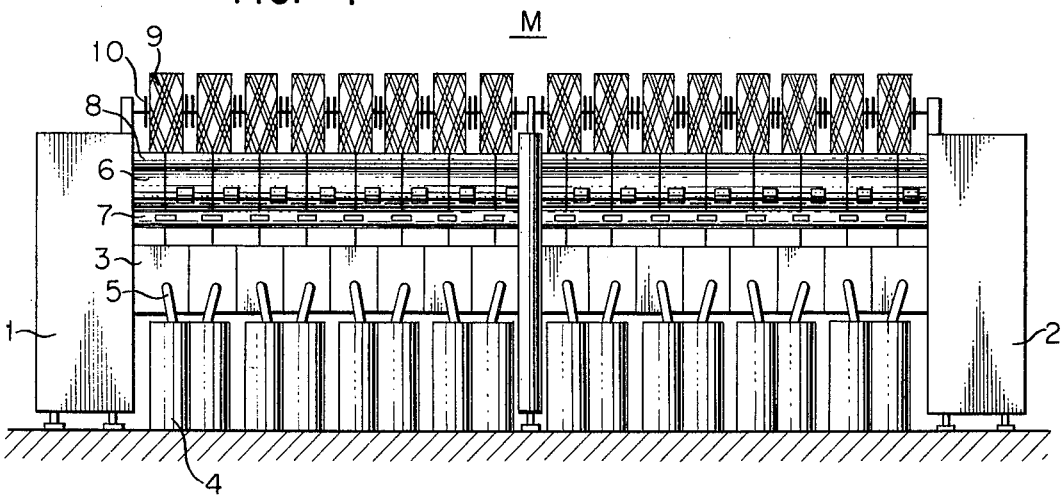
FIG. 1 is a side elevation of a conventional spinning frame.

Referring now to FIG. 1, there is shown a conventional open end spinning frame M. Although the following description is made with respect to a particular spinning machine that is an open end spinning frame, the invention is of course not limited thereto. In FIG. 1, a series of spinning devices 3 are arranged between head stocks 1 and 2 in which not shown drive motors, gear boxes and control mechanism are located. A sliver 5 from each can 4 is spun by the associated spinning device 3 into a yarn 6 which is then taken up by a spun yarn take-up roller 7 and wound through a grooved winding roller 8 on a bobbin 9*a* (FIG. 3), thus being formed into a cheese or yard package 9. The bobbins 9*a* are held for rotation by a respective bobbin holder 10. The formed cheeses 9 are doffed from the associated holders 10 to enable them to be subjected to the to next treatment.

Figure 2:
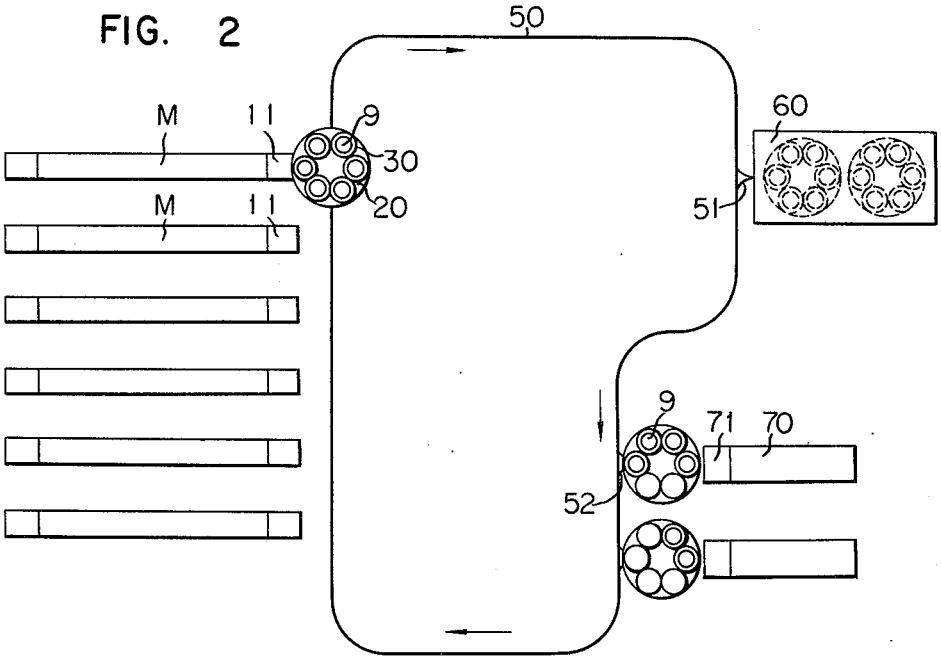
FIG. 2 is a diagrammatic view showing a system according to the instant invention.

In FIG. 2, a system showing an embodiment of the invention is illustrated. The plurality of open end spinning frames M are provided in spaced side-by-side relation with their ends 11 in alignment. The cheeses 9 doffed from such spinning frames M are carried by a cheese transportation vehicle 20 in a manner as hereinafter described. A main pathway 50 (which may be a rail or rails) for the cheese vehicle 20 is so arranged that its portion extends along and near the spinning frame ends 11 and the other portions thereof lie adjacent to separate apparatuses, such as a steam setter 60 and winders 70, where the cheeses 9 are subjected to the necessary spinning steps. The pathway 50 is preferably formed into a closed loop. Side-portions 51 and 52 are provided for directing the vehicle 20 to the steam setter 60 and the winders 70.

Figure 3:
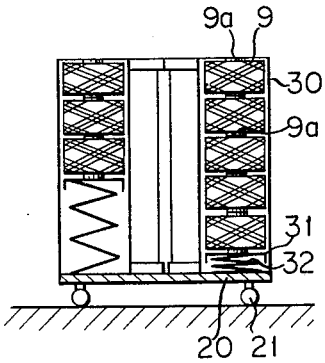
FIG. 3 is a section of a cheese transportation vehicle, particularly showing a manner of arranging the cheeses therein.

As shown in FIG. 3, the cheese transportation vehicle 20 can be provided at the bottom with wheels 21 to facilitate its movement along the pathways 50, 51 and 52. The vehicle 20 may be actuated by an operator or a motor driven traction car (not shown). Disposed on the vehicle 20 are a plurality of cylindrical cheese containers or canisters 30, each being formed in a cylindrical shape similar to the can 4 with an inner diameter slightly larger than the outer diameter of the cheese 9. Within each of the containers 30, a cheese receiving plate 31 is carried for upward and downward movements by a resilient means consisting of a coil spring 32, which is disposed between the plate 31 and the bottom of the container to normally urge the cheese receiving plate 31 upwardly. It is preferable that the coil spring 32 has a suitable spring constant which allows the height of the coil spring to just change by an amount corresponding to the length of the bobbin every time one cheese is taken out of and placed in the container, since this facilitates the putting in and taking out of the cheeses 9. The cheeses 9 are canistered in the container 30 with their bobbins 9*a* being arranged in end-to-end contact relationship. In the embodiment illustrated, each container 30 can contain a maximum number of five cheeses and each vehicle 20 can carry six containers 30 thereon. Therefore, the number of cheese 9 carried by one vehicle is limited to 30, but the invention is not limited thereto. With respect to the empty container, the movable plate is in the uppermost position flush with the upper end of the empty container.

In operation, the cheeses 9 produced by the open end spinning frames M are transferred to the spinning frame ends 11 by not shown conveying means, which is normally a belt conveyer, installed on the respective spinning frames M and hence into the containers 30 on the cheese transportation vehicle 20, which is at this time located at a canistering position near the spinning frame ends 11, in the aforementioned manner allowing the bobbins 9*a* to be in end-to-end contact relationship. It is preferable that each transportation vehicle 20 be loaded with cheeses 9 equal in number to or more than those held on one or both of the sides of each spinning frame. The transportation vehicle 20 loaded with the cheeses, the number of which corresponds by way of example to that of the spinning units of one spinning frame, is transported along the main pathway 40 and the side portion 51 to the steam setter 60. Thus, the cheeses 9 can be introduced into a steaming chamber of the steam setter 60 to be subject to the steam setting without being taken out of the associated container. In this case, the cylindrical interior of the container provides the minimum space for accumulating the cheeses and makes it possible that even if the cheeses contact the surface of the container interior, the contact is made along straight lines. This substantially does not affect the steam setting process. Then, the cheeses after having been treated along with the vehicle 20 in the steaming chamber are returned on the main transportation pathway 50 along the side portion 51 and are thereafter led along the side portion 52 to the winders 70. The winder 70 is provided at its one end with a conventional cheese supply device 71, which takes the cheeses out of the container one by one and supplies them to the winder 70. The cheeses contained in at least one container are processed by the same winder, that is the cheeses are handled by at least one container unit. When all the containers on the vehicle 20 become empty, the vehicle 20 is returned along the main transportation pathway 50 as shown by the arrow to the canistering position near the spinning frame end 11 to newly receive the cheeses from the spinning frame. At this time the vehicle 20 may transport cheese bobbins to the doffing machine of the spinning frame.

Although, in the embodiment, the cheeses from the spinning frames are first fed to the steam setter by way of example, they may be transferred to a different processing apparatus or apparatuses.

What I claim is:

1. A working method for handling yarns which have been wound on respective cylindrical bobbins in relatively large diameter packages and have been produced by one spinning machine, the packages being successively transported to one end of the spinning machine, the working method comprising the steps of placing the first of several successive packages, which have reached the end of the spinning machine, into one of a plurality of cylindrical canisters separately arranged on a package transporting device in manner such that the bobbins of the packages are stacked in end-to-end contact relationship; displacing all the canisters on the package transporting device to allow the next several successive packages to be placed into another canister in the same manner, the above procedures being repeated until all the canisters are filled with the packages; and transporting the package transporting device which carries thereon the package loaded canisters, to a next processing position while maintaining the package loaded canisters thereon.

2. A method according to claim 1, wherein all the cheeses produced during one doffing cycle of the spinning machinery are transported by the same transporting device to the next processing position.

3. A method according to claim 1, further comprising the step of transporting the transporting device from the next processing position to a further processing position where the cheeses are handled by at least one container unit.

4. A method according to claim 3, wherein heat setting of the cheeses is performed in the next processing position and rewinding of the cheeses is performed in the further processing position.

* * * * *